US007645956B2

(12) United States Patent
Weber et al.

(10) Patent No.: US 7,645,956 B2
(45) Date of Patent: Jan. 12, 2010

(54) FAIL SAFE MEMBRANE SWITCHES

(75) Inventors: Henry G. Weber, Newport Beach, CA (US); Manuel Estrada, Alhambra, CA (US); John Rowe, La Habra, CA (US); Jeffrey F. Johnson, Mission Viejo, CA (US); Edward W. Duhon, Setauket, NY (US)

(73) Assignee: Weber Precision Graphics, Santa Ana, CA (US)

( * ) Notice: Subject to any disclaimer, the term of this patent is extended or adjusted under 35 U.S.C. 154(b) by 665 days.

(21) Appl. No.: 11/418,641

(22) Filed: May 5, 2006

(65) Prior Publication Data

US 2008/0202911 A1 Aug. 28, 2008

Related U.S. Application Data

(60) Provisional application No. 60/681,633, filed on May 16, 2005.

(51) Int. Cl.
*H01H 3/00* (2006.01)

(52) U.S. Cl. ..... 200/512

(58) Field of Classification Search ..... 200/5 A, 200/512–515, 517, 600, 61.41–61.44, 85 R, 200/86 R, 86 A, 85 A; 341/22, 24–26, 34; 345/168, 169, 173, 174, 178
See application file for complete search history.

(56) References Cited

U.S. PATENT DOCUMENTS

| | | | | | |
|---|---|---|---|---|---|
| 5,175,443 | A * | 12/1992 | Tabuchi | 307/119 |
| 5,722,287 | A * | 3/1998 | Forstein | 73/172 |
| 5,900,270 | A * | 5/1999 | Smith et al. | 427/8 |
| 5,962,118 | A * | 10/1999 | Burgess | 428/308.4 |
| 6,455,793 | B1 * | 9/2002 | Kasahara et al. | 200/86 R |
| 6,888,081 | B2 * | 5/2005 | Friedrich et al. | 200/517 |
| 6,898,842 | B2 * | 5/2005 | Kasahara et al. | 29/622 |
| 7,373,754 | B2 * | 5/2008 | Albiero | 49/27 |

* cited by examiner

*Primary Examiner*—Michael A Friedhofer
(74) *Attorney, Agent, or Firm*—Hani Z. Sayed; Rutan & Tucker, LLP

(57) ABSTRACT

Membrane switches have at least one trace with two leads, such that its integrity can be tested during deployment of the switch.

3 Claims, 5 Drawing Sheets

FIG. 7
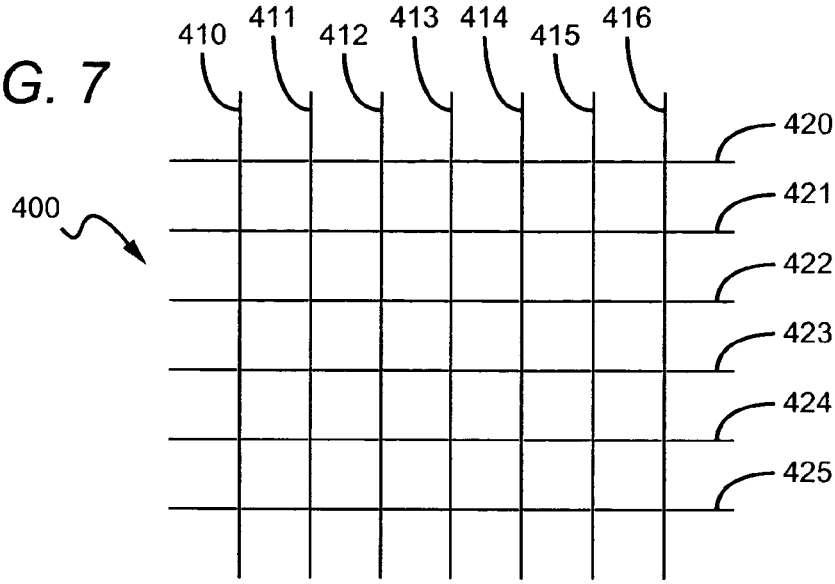
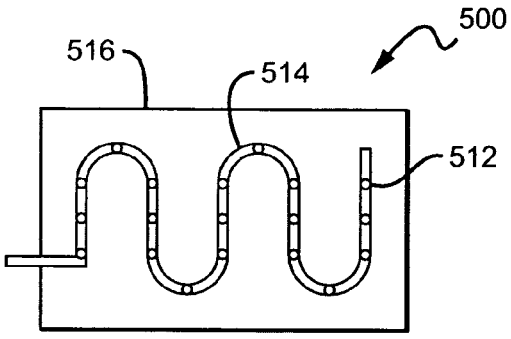
FIG. 8
PRIOR ART
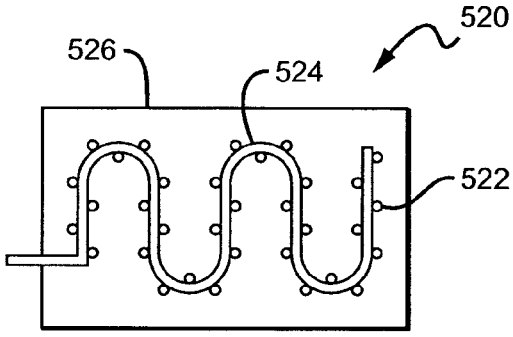
FIG. 9
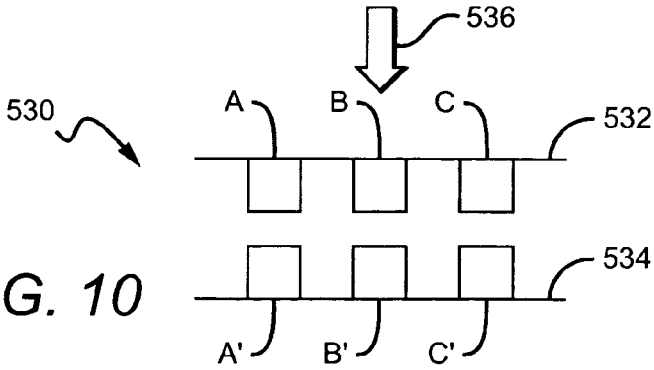
FIG. 10

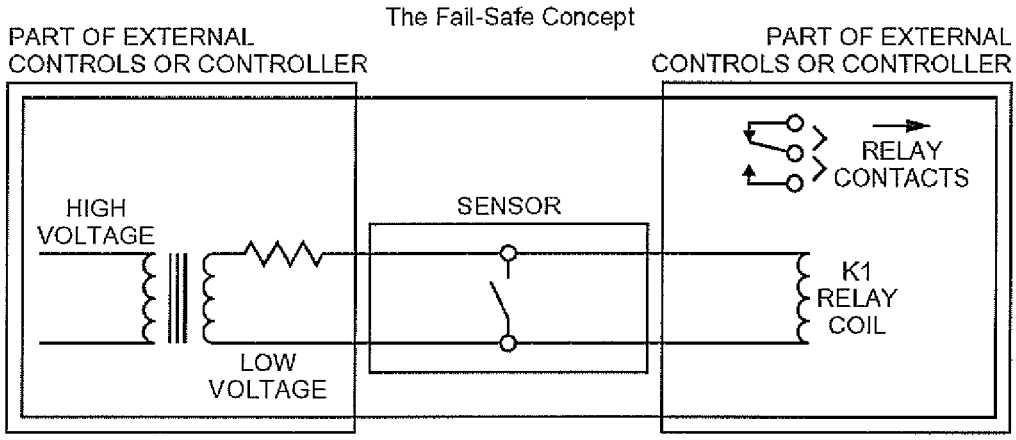

Fail-Safe Supervised Circuit Concept
All Weber 4 Wire Sensors Utilize This Concept

- Normal Conditions - constant current flow (I) holding relay coil (K1) energized.
- Loss of Power - no current clow (I) and relay coil (K1) is de-energized.
- Actuation of Sensor - relay coil (K1) is shorted and de-energized.
- Failure of Sensor in the closed position - relay coil (K1) is shorted and de-energized.
- Failure of Sensor in th open position (broken wire, severed switch or conductor) no path for current flow (I) and relay coil (K1) is deenergized.
- Resistor R - limit current flow through the sensor when activated.

Fig. 15

FAIL SAFE MEMBRANE SWITCHES

This application claims priority to U.S. provisional application Ser. No. 60/681,633 filed May 16, 2005.

FIELD OF THE INVENTION

The field of the invention is membrane switches.

BACKGROUND

Membrane switches have at least one contact that is on, or made of, a flexible substrate, i.e. a membrane layer. There is always a second layer against which the membrane layer is pressed, and that second layer can be either static or flexible.

Although it is possible to produce membrane switches that rely upon capacitive, ferrite core, or hall effect, membrane switches typically utilize a direct (Ohmic) contact in which the poles of the switch make transient physical contact. Thus, pressure on the membrane layer physically closes a circuit by contacting one electrical trace to another, and upon release these "poles" separate as the flexing membrane returns to its original position.

The momentary type of action, ready accommodation to visual design feature, low cost, and relatively high reliability, all cooperate to provide applicability in innumerable applications. Among other things, membrane switches are very commonly used in DC logic-level circuits such as those used in computer keyboards, on medical equipment, and in television and other hand-held controllers.

Although membrane switches are fairly reliable, they are known to fail. Failures can occur for any number of reasons, including operator error, moisture, excessive use, manufacturing defects, and so forth. In some applications failure carries an extremely high cost, and it is therefore necessary to utilize some sort of self check that identifies a switch as being defective, or at least allows the switch to continue functioning with a defect. Exemplary applications requiring failsafe operation include pressure sensing floor mats used for security purposes, and operational controls on life support equipment.

As used herein the term failsafe device means that the device can be interrogated at all times to detect a failure. Failsafe capabilities appear to be unknown in membrane switches. Existing membrane technology generally relies upon orthogonally parallel traces upon opposing surfaces. In normal operation the traces do not touch each other, and there is only a single lead from each trace. Such designs are not conducive to failsafe operation because there is no way to test the integrity of the traces. Indeed, Touch-Sensor™ advertises their TouchCell™ switches (which are not membrane switches) as the only "touch technology" switches that are recognized by UL as failsafe switches. (http://www.touchsensor.com/faq.html). The Touch Sensor™ web page, as well as all other patents, applications, web sites, articles and the like referenced herein are incorporated by reference in their entirety. Where a definition or use of a term in a reference, which is incorporated by reference herein, is inconsistent or contrary to the definition of that term provided herein, the definition of that term provided herein applies and the definition of that term in the reference does not apply.

U.S. Pat. No. 5,175,443 to Tabuchi (December 1992) does teach a membrane switch that can detect a false positive (always on) condition. There, a membrane switch has closely disposed duplicate traces. When the switch is operating normally, pressure sufficient to establish a circuit in one of the duplication traces is assumed to concurrently establish a circuit in the close duplicate. If one of the switches becomes defective because one of the traces has peeled away from its base, a logic circuit can detect the failure by comparing the current in the duplicate traces. Unfortunately, devices using to the '443 technology are only able to detect false positive situations—they are unable to detect false negative situations, in which the switch fails to record a proper "on" situation. Such switches are not considered failsafe as the term is used herein because the integrity of apparently viable traces cannot be tested.

Existing membrane circuits are also designed to detect pressure at a given point, on the membrane, or pressure on the membrane at any point. And such circuits merely detect on-off. Membrane circuits are apparently unknown that detect sizes and shapes (i.e., footprints) or weights. Significantly, it is exactly in detection of sizes, shapes and weights that failsafe operation is so critical.

Thus, there is still a need for additional development of failsafe membrane switches, especially for membrane switches that detect sizes, shapes and/or weights

SUMMARY OF THE INVENTION

The present invention provides apparatus, systems and methods for novel classes of membrane switches. Novel classes include switches using: (a) failsafe four-wire series circuits; (b) failsafe two-wire circuits; (c) ladder circuits (two- and four-wire non-failsafe); (d) multi-zone; and (e) weight detecting technology.

In other aspects of the inventive subject matter, a failsafe membrane switch serving as safety mat can be manufactured much thinner than prior art failsafe safety mats—on the order of no more than ¼ inch thickness, or no more than ⅙ inch, as opposed to ⅜" to ½". As used herein the term "mat" is intended to be interpreted broadly, to include mats upon which one would stand, as well as mats on tables and other surfaces upon which one would not ordinarily stand.

Various objects, features, aspects and advantages of the present invention will become more apparent from the following detailed description of preferred embodiments of the invention, along with the accompanying drawings in which like numerals represent like components.

BRIEF DESCRIPTION OF THE DRAWING

FIG. 7 is a schematic of traces in a cross-hatch multi-zone membrane switch design.

FIG. 8 is a schematic of a bottom layer of a prior art membrane switch in which spacer dots are positioned over one of the traces.

FIG. 9 is a schematic of a bottom layer of a membrane switch in which spacer dots are positioned adjacent one of the traces.

FIG. 10 is a schematic of a membrane switch with three different sets of traces.

FIG. 15 is an explanation page from a proposed marketing piece.

DETAILED DESCRIPTION

Figure 1:
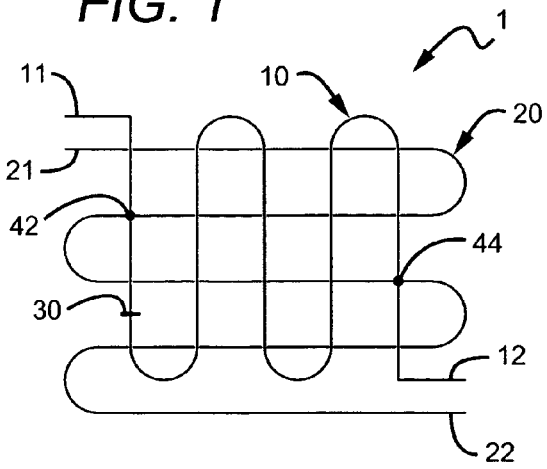
FIG. 1 is a schematic of traces in a four-wire failsafe membrane switch design.

In FIG. 1 a membrane switch 1 has two layers (not shown), the top layer carrying trace 10 and the bottom layer carrying trace 20. Because each trace 10, 20 has two leads rather than the normal one lead (trace 10 has leads 11, 12, and trace 20 has leads 21, 22) a single break anywhere along either or both of the traces 10, 20 can be accommodated without loss of function. If, for example, there is a break at 40, pressure on 40 sufficient to electrically connect the two traces can still be detected using the upper left-hand leads. Similarly, pressure on 44 sufficient to electrically connect the two traces can still be detected using the bottom right-hand leads. In addition, switches according to FIG. 1 are failsafe because each trace is double ended, the integrity of the entire trace can be detected without testing each of the pressure points.

It is highly preferred that integrity testing can be accomplished while the switch is deployed in a useful operational setting other than merely testing itself. One could do this continuously without interrupting the useful function, by passing a low voltage alternating current along the trace being testing. One could also test the switch discontinuously by passing any suitable AC or DC voltage along the current a periodic intervals. Suitable intervals can range from less than a second to every minute, once every hour, or even less frequently.

Figure 2:
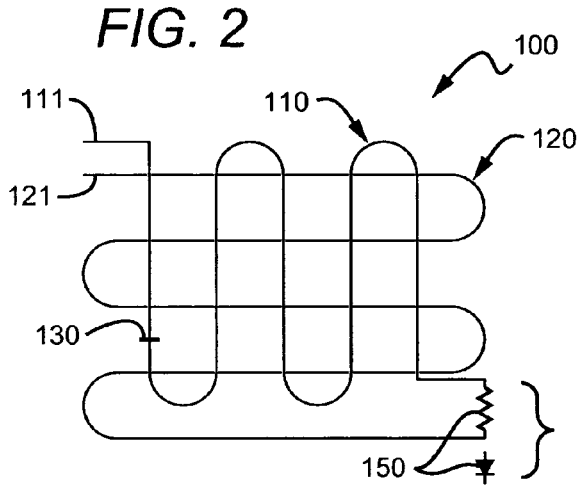
FIG. 2 is a schematic of traces in a two-wire failsafe membrane switch design.

In FIG. 2 a membrane switch 100 again has two layers (not shown), the top layer carrying trace 110 and the bottom layer carrying trace 120. Here each trace 110, 120 has only two leads (trace 110 has lead 111 and trace 120 has lead 121), but because of resistor or diode or other suitable element 150, the switch can immediately detect interruption at 130, or elsewhere along the traces. Here again, switches according to FIG. 2 are failsafe because the entire trace (taken to be top trace 110 and bottom trace 120 together) is double ended, and the integrity of the trace can be detected without testing each of the pressure points.

Figure 3:
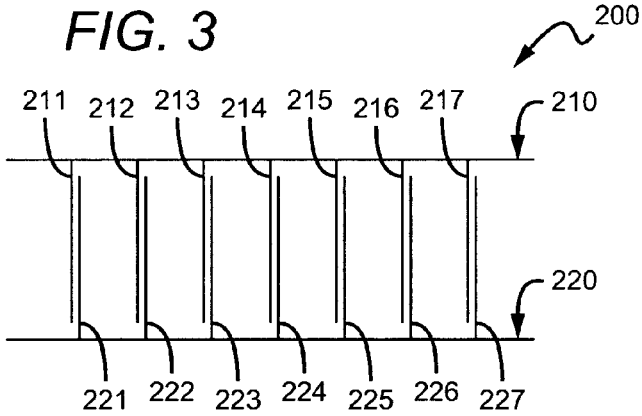
FIG. 3 is a schematic of traces in a four-wire ladder membrane switch design.
Figure 4:
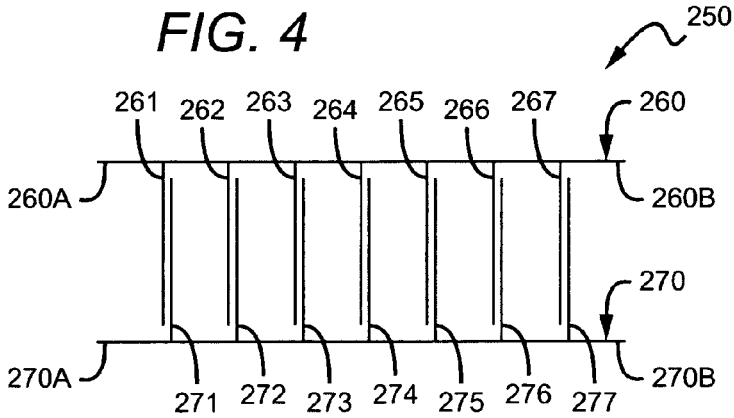
FIG. 4 is a schematic of traces in a two-wire ladder membrane switch design.

In FIG. 3 a ladder circuit 200 has upper trace 210 with branches 211-217, and lower trace 220 with branches 221-227. The circuit can be triggered by placing pressure along any of the branches. The design is not failsafe, but can be made failsafe as in FIG. 4. There, a ladder circuit 250 has upper trace 260 with branches 261-267, and lower trace 270 with branches 271-277. The advantage here is that there are four leads wires 260A, 260B, 270A, and 270B.

Figure 5:
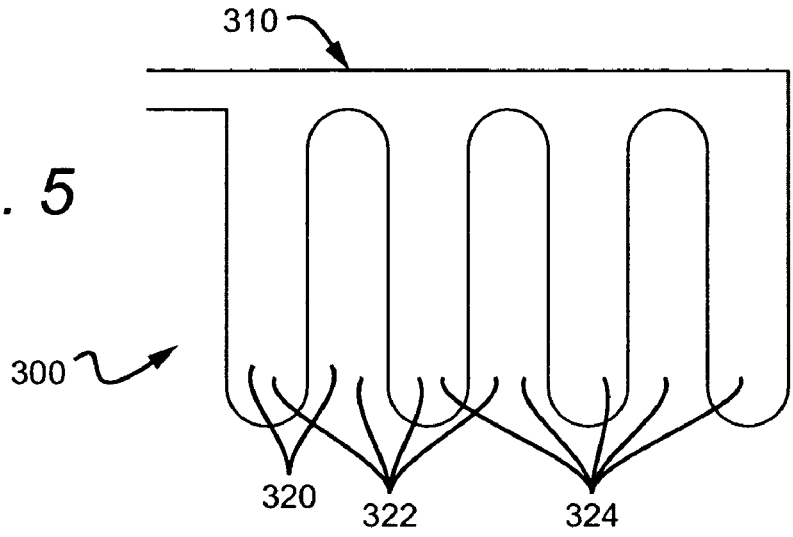
FIG. 5 is a schematic of traces in a first multi-zone membrane switch design.
Figure 6:
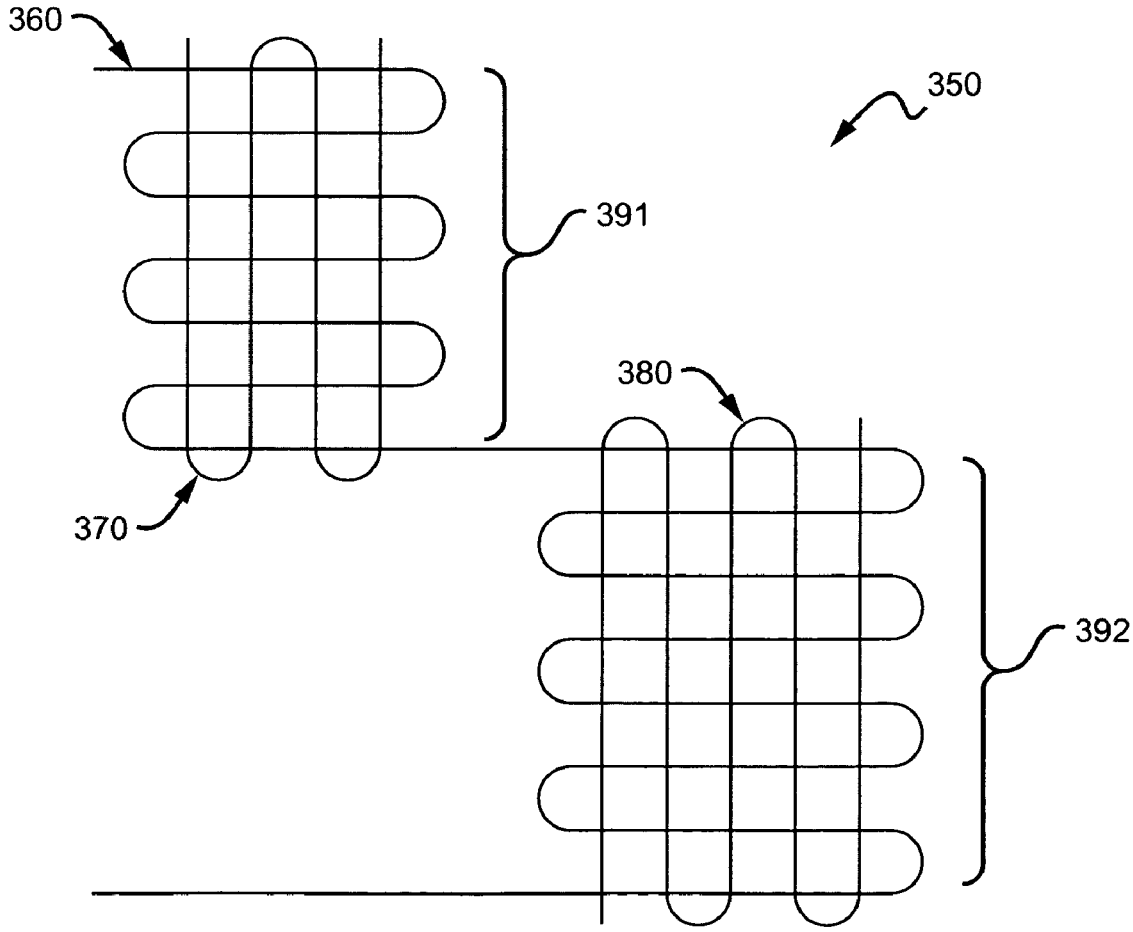
FIG. 6 is a schematic of traces in a second multi-zone membrane switch design.

In FIG. 5 a membrane switch 300 has a double leaded upper trace 310, and three separate bottom traces 320, 322, and 324. The system detects pressure in distinct zones, and is failsafe in that pressure on a given zone will close multiple circuits, e.g. using 320 and 322, or 322 and 324. As drawn, the switch of FIG. 5 is not entirely failsafe, but it can be made failsafe as shown in FIG. 6. In FIG. 6 a membrane switch 350 is also multi-zonal, having a double leaded upper trace 360 that cooperates with a first double ended bottom trace 370 in zone 391 and a second double ended bottom trace 380 in zone 392. In this embodiment each zone 391 has failsafe protection because each trace has two leads.

In FIG. 7 a membrane switch 400 is has a plurality of double leaded upper traces top traces 410-416 and a plurality of double leaded bottom traces 420-425. The double leading of these traces provides failsafe capability, and the plurality of independent traces provides an ability to determine sizes, shapes, and/or x/y coordination.

In FIG. 8 a typical prior art printed membrane switch 500 has spacer dots 512 positioned directly on the trace 514 of the bottom layer 516. One aspect of the inventive subject matter is that the spacer dots are placed adjacent the traces as opposed to being placed on top of the traces. In FIG. 9 an inventive membrane switch 520 has a bottom layer 526 upon which are placed a trace 524 and spacer dots 522. Placement of the spacer dots 522 adjacent the trace 524 prevents dead spots which would otherwise occur if the spacer dots were place directly on top of the traces.

A related improvement over the prior art involves modification of the spacers to detect differences in weight or depth. In FIG. 10 for example, a membrane switch 530 has upper 532 and lower 534 membranes with three different sets of traces AA', BB' and CC'. Each of the sets of traces is double ended so that the entire switch is failsafe. A light force in the direction of arrow 536 will close a circuit between A and A'; a greater force will close a circuit between B and B', and an even greater force will close a circuit between C and C'. Those skilled in the are will appreciate that closing the CC' circuit will usually mean that the AA' and BB' circuits are already closed, and damage to the AA' and BB; circuits is avoided because of the flexibility of at least the top layer 532.

The ability to close different circuits as a function of the applied pressure has many uses, including weighing. Thus, a security mat may be designed to send one signal when it experiences a relatively small load (such as a bird), another signal with a medium load (such as a person), and another signal with a heavy load (such as a cart with boxes). The technology can also be useful in many other areas, such as in computers, where different signals can be sent depending on how hard a key I pressed. Thus, in a QWERTY keyboard, pressing the "A" key lightly may be associated with a small letter "a", but pushing the same key with greater force may be associated with the capital letter "A", and pushing even harder may be associated with a common word such as "Anderson".

Depending on the spacing of the traces and spacer dots (not shown) it is contemplated that membrane switches can be used to detect object sizes as low as ¼ inch (6.35 mm) or even ⅛ inch or $1/16^{th}$ inch in diameter, length, etc. Similarly, it is contemplated that membrane switches can be used to detect object sizes as low as 6 mm, 3 mm or 1.5 mm. On the upper end, it is contemplated that floor mat type detectors could have a diameter or edge of at least 6 inches, 12 inches, 18 inches, and in rectangular form could be as large as 24 inches by 48 inches, 36 inches by 72 inches, or even 48 inches by 96 inches. Roughly corresponding metric measurements are 0.6 meters by 1.3 meters, 0.9 meters by 1.8 meters, and 1.3 meters by 2.6 meters. The types of shapes that can be detected include solid shapes (round, rectangular, oval, polygonal, etc) as well as donuts and other shapes with open areas, and irregular shapes.

Figure 11:
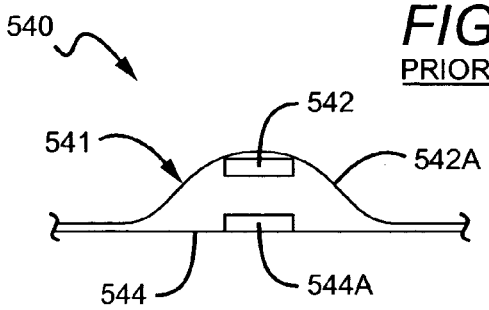
FIG. 11 PRIOR ART
FIG. 11 is a schematic of a prior art membrane switch in which the upper layer has a bubble that separates the traces.
Figure 12:
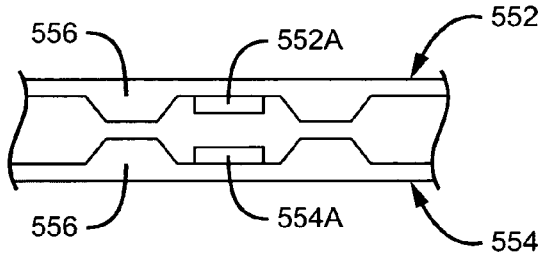
FIG. 12 is a schematic of a membrane switch in which dimples that serve to limit the force of one trace upon the other.
Figure 13:
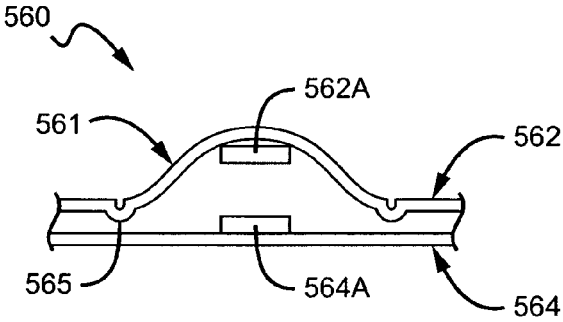
FIG. 13 is a schematic of the membrane switch of FIG. 11, modified to include embossment.

Another aspect of the inventive subject matter involves embossing. It is common to place a trace on the underside of a dimpled up embossment. Thus, in prior art FIG. 11, for example, top membrane 542 of a membrane switch 540 includes a trace 542A, and the bottom membrane 544 includes a trace 544A. A raised area 541 keeps the traces apart until an appropriate downward force is imposed on membrane 542 above the trace 542A. In FIG. 12, however, top membrane 552 includes a trace 545A, and the bottom membrane 554 includes a trace 554A, but there are adjacent dimples 556 that serve to limit the force of one trace 552A upon the other 554A. In effect, the dimples 556 limit the contacting force because motion bottoms out when the dimples collide. Among other benefits, this can prevent damage to the traces, and can thereby considerably extend the lifespan of the switch. FIG. 13 demonstrates how dimpling embossment could be used to modify the prior art membrane of FIG. 11.

Figure 14:
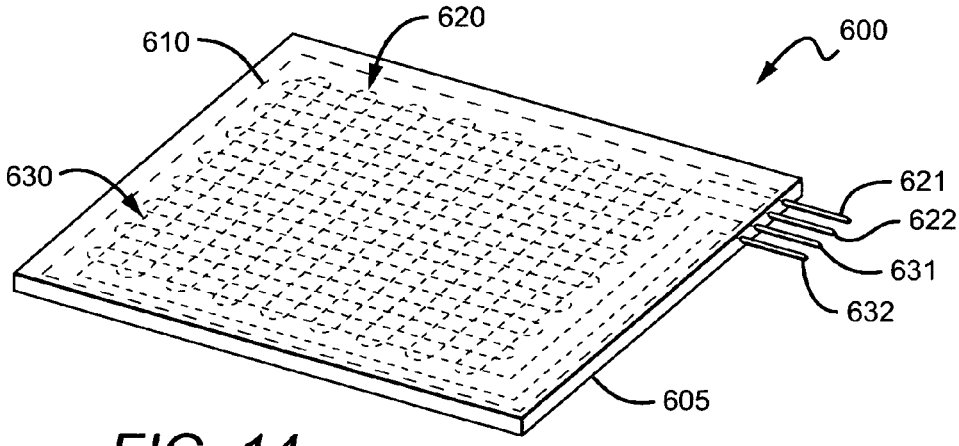
FIG. 14 is a security sensor having a failsafe membrane sensor.

In FIG. 14 a detection sensor 600 generally includes a cover 605, and failsafe membrane sensor 610, which includes upper trace 620 connected to lead lines 621, 622, and lower trace 630 connected to lead lines 631, 632. Sensor 600 is to be interpreted generically as being dimensioned to be useful as a floor security mat, with dimensions along one axis or diameter of at least 26, 48 inches, 36 inches, and 96 inches.

A major improvement of the various failsafe designs contemplated herein is that they can be much thinner than the ⅜-½ inch thick (10 to 13 mm) failsafe floor mats currently available. In preferred embodiments the inventive switches can readily be produced at least as thin as 1/16 inch (1.6 mm). This improvement arises in part because a second lead line to each trace is all that is needed within the contacting portion of the switch to effectuate failsafe testing. The improvement can also arise as a function of embossing at least one of the active layers.

Materials suitable for the inventive switches include all previously known membrane switch materials, including especially Lexan™ or other polycarbonate resin. To reduce thickness and improve moisture and water resistance, the switch can be conformally coated with polyurethane or other spray. Such coatings can provide water resistance to at least 3 atmospheres.

FIG. 15 is an explanation page from a proposed marketing piece that explains various aspects of preferred embodiments of failsafe membrane switches.

Thus, specific embodiments and applications of failsafe and other membrane switches have been disclosed. It should be apparent, however, to those skilled in the art that many more modifications besides those already described are possible without departing from the inventive concepts herein. The inventive subject matter, therefore, is not to be restricted except in the spirit of the appended proposed claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A membrane switch comprising:

first and second opposing traces that can be contacted together to form an electrical circuit;

wherein at least one of the traces has two leads such that its integrity can be tested while the switch is deployed; and a third trace, that cooperates with the first and second traces to establish at least two separately detectable zones.

2. The switch of claim 1, wherein the third trace has two further leads that can be used to test integrity of the third trace during deployment of the switch.

3. A membrane switch comprising:

first and second opposing traces that can be contacted together to form an electrical circuit wherein the first trace has the two leads, and the second trace includes two additional leads;

wherein at least one of the traces has two leads such that its integrity can be tested while the switch is deployed; and a third trace that has two further leads that can be used to test integrity of the third trace during deployment of the switch.

* * * * *